US009067308B2

(12) United States Patent
Lai

(10) Patent No.: US 9,067,308 B2
(45) Date of Patent: Jun. 30, 2015

(54) RATCHET WRENCH AND BODY USED IN RATCHET WRENCH

(71) Applicant: Apex Tool (HK) Limited Taiwan Branch, Situn District, Taichung (TW)

(72) Inventor: Yu-Ching Lai, Taichung (TW)

(73) Assignee: Apex Tool (HK) Limited Taiwan Branch, Taichung (TW)

( * ) Notice: Subject to any disclaimer, the term of this patent is extended or adjusted under 35 U.S.C. 154(b) by 263 days.

(21) Appl. No.: 13/727,398

(22) Filed: Dec. 26, 2012

(65) Prior Publication Data

US 2013/0228048 A1 Sep. 5, 2013

(30) Foreign Application Priority Data

Mar. 2, 2012 (TW) ..... 101107061 A

(51) Int. Cl.
*B25B 13/46* (2006.01)

(52) U.S. Cl.
CPC ..... *B25B 13/462* (2013.01); *B25B 13/463* (2013.01); *B25B 13/468* (2013.01)

(58) Field of Classification Search
CPC ..... B25B 13/06; B25B 13/36; B25B 13/46; B25B 13/462; B25B 13/463; B25B 13/468
USPC ..... 81/61–63.2
See application file for complete search history.

(56) References Cited

U.S. PATENT DOCUMENTS 2,188,846 A 1/1940 Rueb
2,201,827 A * 5/1940 Froeschl et al. ..... 81/63.1
6,282,992 B1 9/2001 Hu
6,666,112 B2 * 12/2003 Hu ..... 81/63.1
7,047,842 B1 * 5/2006 Lee ..... 81/63
7,089,830 B2 * 8/2006 Hu ..... 81/63.1
7,237,460 B2 7/2007 Hu
2004/0055424 A1 3/2004 Huang
2004/0139823 A1 7/2004 Hu
2005/0257650 A1 11/2005 Hu

FOREIGN PATENT DOCUMENTS

CA 2 356 549 A1 6/2002
EP 1 215 014 A2 6/2002

(Continued)

OTHER PUBLICATIONS

Office Action from State Intellectual Property Office of People's Republic of China in corresponding Chinese application 201210053654.1 dated Sep. 23, 2014, 11 pp.

(Continued)

*Primary Examiner* — Hadi Shakeri
(74) *Attorney, Agent, or Firm* — Juan Carlos A. Marquez; Bacon & Thomas PLLC

(57) ABSTRACT

A ratchet wrench comprises a body, a ratchet, a first pawl, and a second pawl. Each of the first pawl and the second pawl can move between a first position and a second position relative to the ratchet. The first position is a position where the ratchet wrench can transmit torque to said driven element from respective first pawl or second pawl, and the second position is a position where no torque is transmitted from respective first pawl or second pawl. A control member can pivot or rotate to stay in one of a first position, a second position, and a neutral position for different operations. The body has an operating part comprising a groove. The groove comprises two accommodation chambers having inclined surfaces and can accommodate the first pawl and the second pawl.

12 Claims, 4 Drawing Sheets

(56) References Cited

FOREIGN PATENT DOCUMENTS

| | | |
|---|---|---|
| TW | 343558 U | 11/2008 |
| TW | 434653 U | 8/2012 |

OTHER PUBLICATIONS

Extended European Search Report and Search Opinion of European Patent Office in corresponding European application 12199697.9 dated Aug. 11, 2014, 7 pp.

* cited by examiner

RATCHET WRENCH AND BODY USED IN RATCHET WRENCH

FIELD OF THE INVENTION

The present invention relates to a ratchet wrench, which is used to rotate a screw or a nut or a similar object.

BACKGROUND OF THE INVENTION

In the prior art, patents such as U.S. Pat. No. 2,188,846, U.S. Pat. No. 2,201,827, U.S. Pat. No. 7,237,460, CA2356549, U.S. Pat. No. 6,282,992B1, and US2004139823, U.S. Pat. No. 7,237,460B2 and EP1215014A2 have put forward various conventional art of a ratchet wrench. The conventional art in the early period has advantages, but still needs continuous improvement.

SUMMARY OF THE INVENTION

The present invention substantially provides:

a body;

a ratchet provided in the body and having a plurality of teeth defining a circumference or periphery of the ratchet;

a first pawl, elastically urged against an inner peripheral wall of the body, so as to be coupled with the ratchet, wherein the first pawl is arranged in the body and can be moved to any of the following positions relative to the ratchet:

a first position, where at the first position, the first pawl is arranged between the body and the ratchet, the first pawl being coupled with the ratchet so that the body provides a transmitted torque in a first rotation direction through the first pawl; and a second position, where at the second position, the first pawl does not transmit the torque;

a second pawl, elastically urged against the inner peripheral wall of the body, so as to be coupled with the ratchet, where the second pawl is arranged in the body and can be moved to any of the following positions relative to the ratchet:

a first position, where at the first position, the second pawl is arranged between the body and the ratchet, the second pawl being coupled with the ratchet so that the body provides a transmitted torque in a second rotation direction through the second pawl; and a second position, where at the second position, the second pawl does not transmit the torque;

a control member, capable of being operated (by pivoting or rotating) to stay in one of at least the following positions: a first position and a second position, where:

when the control member is at its first position, the first pawl is coupled with the control member and therefore away from the first position of the first pawl so that the second pawl is allowed to be coupled with the ratchet, so as to enable the body to provide the transmitted torque in the second rotation direction; and when the control member is at its second position, the second pawl is coupled with the control member and therefore away from the first position of the second pawl so that the first pawl is allowed to be coupled with the ratchet, so as to enable the body to provide the transmitted torque in the first rotation direction.

Other embodiments of the present invention and detailed advantageous features can be appreciated from the following Brief description of the drawings and Detailed Description.

DETAILED DESCRIPTION

Figure 1:
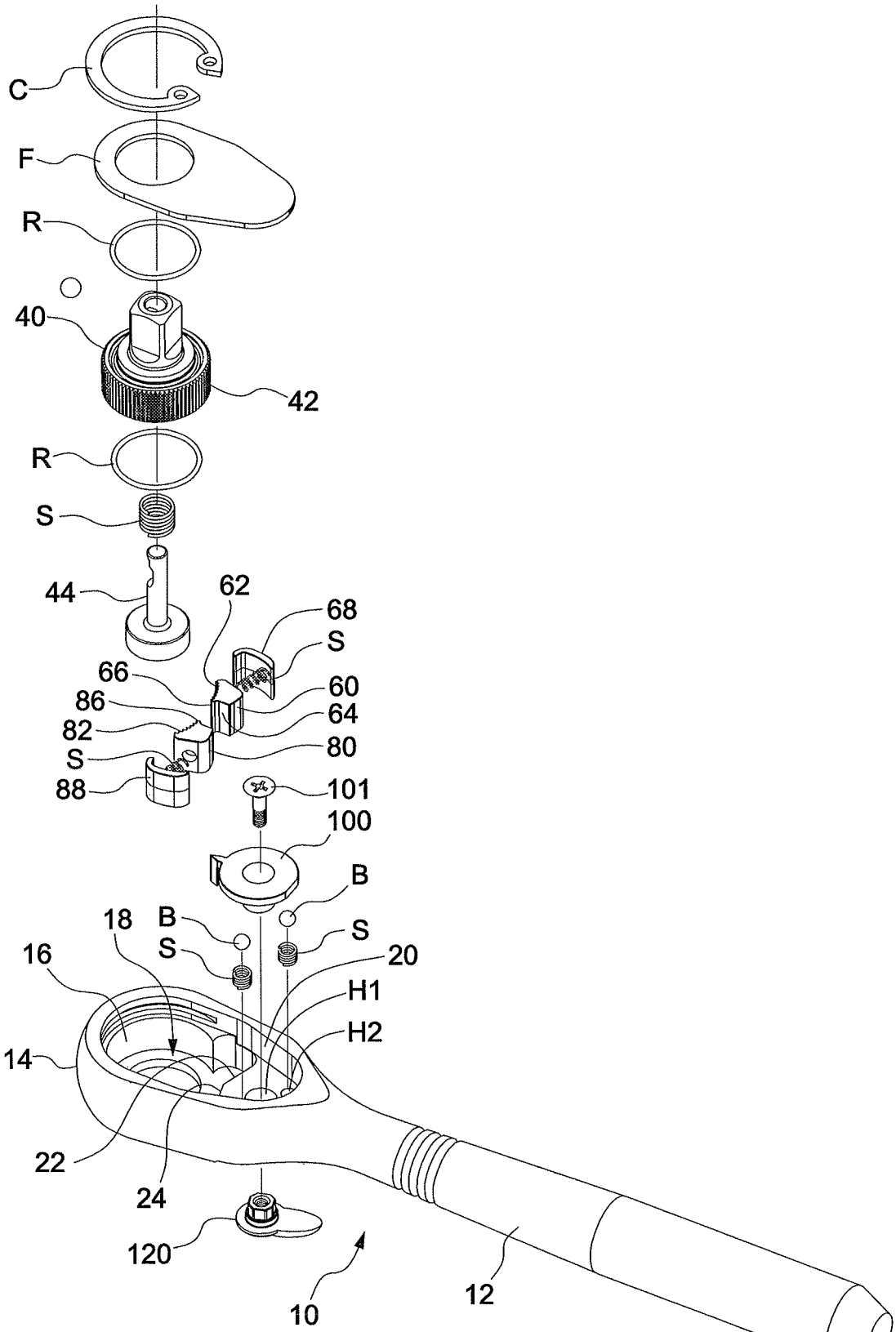
FIG. 1 is an exploded view of the present invention.
Figure 2:
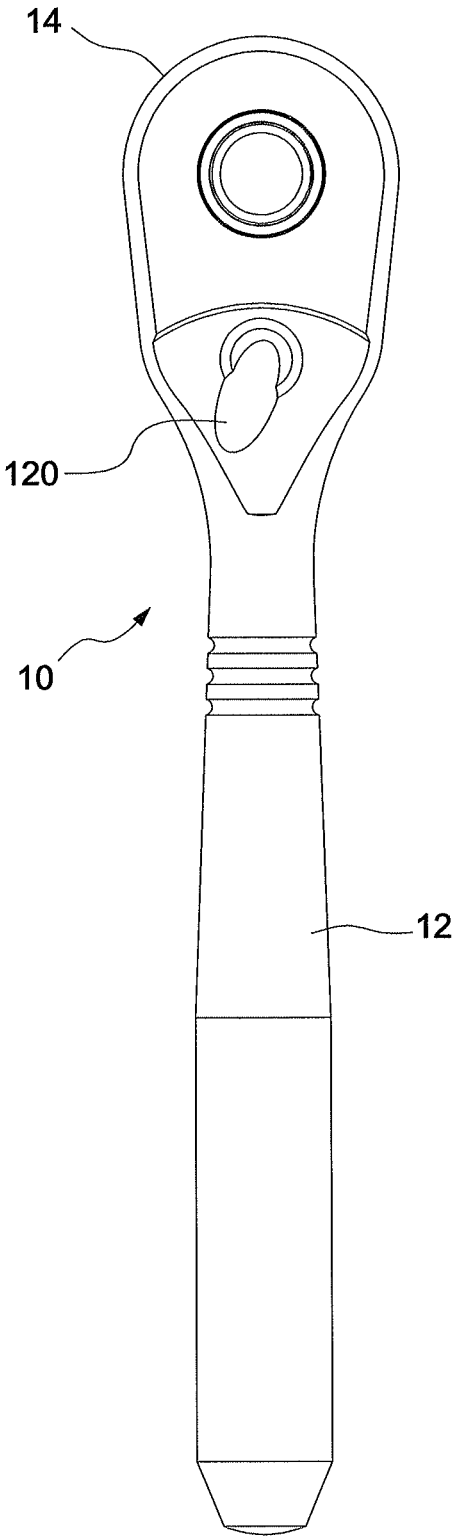
FIG. 2 is a side view after assembly of the present invention.
Figure 3:
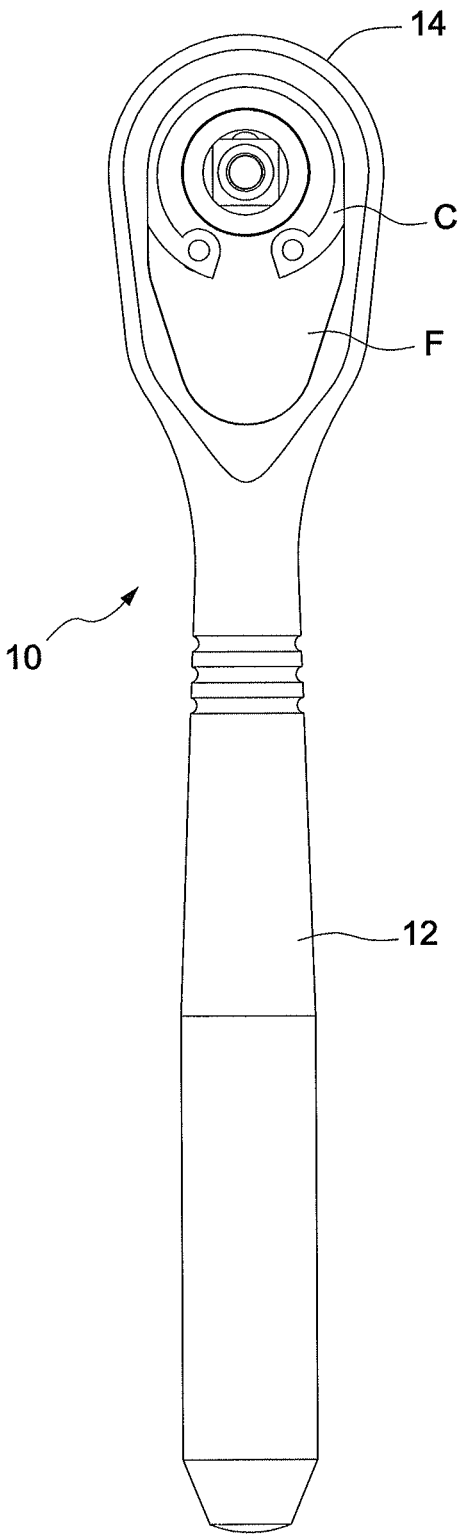
FIG. 3 is another side view after assembly of the present invention.
Figure 4A:
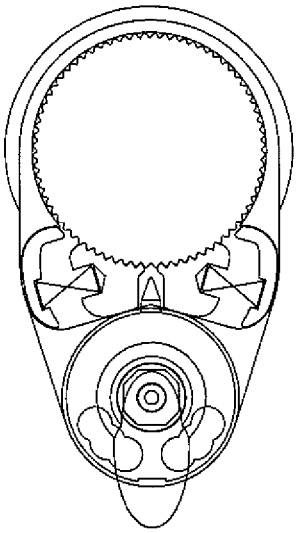
FIG. 4A and FIG. 4B are schematic views showing the switching operation according to the present invention.
Figure 4B:
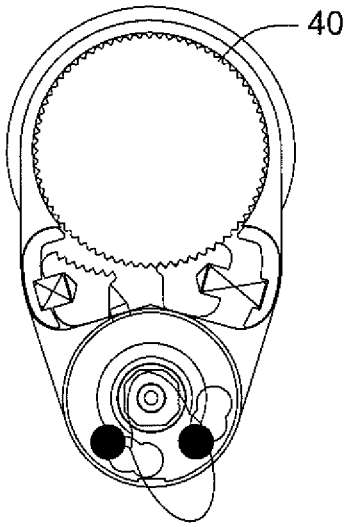
Figure 5:
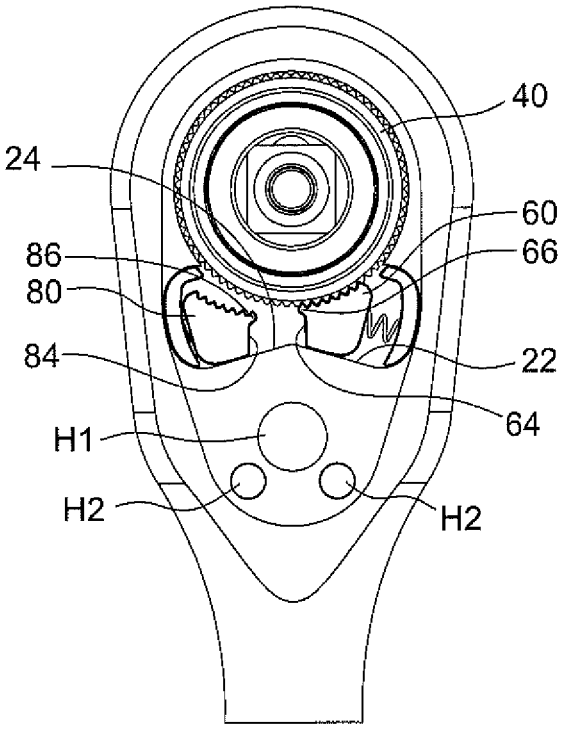
FIG. 5 is another schematic view showing the switching operation of the present invention, where the control member and switch are removed to show an internal structure.

As shown in FIG. 1, FIG. 2, FIG. 3, FIG. 4A, FIG. 4B, FIG. 5, FIG. 6A, FIG. 6B, FIG. 6C, FIG. 6D, and FIG. 7, a ratchet wrench of the present invention mainly comprises: a body (10) having a handle (12); a ratchet (40) arranged in the body (10) and having a plurality of teeth (42) defining a circumference of the ratchet (40); a first pawl (60) and a second pawl (80); and a control member (100).

The body (10) comprises an operating part (14). The operating part (14) comprises a groove (16) formed of a bottom wall (18), and an inner peripheral wall (20) surrounding the bottom wall (18). A front end of the groove (16) can accommodate the ratchet (40), the first pawl (60) and the second pawl (80) therein. A first wall (22) and a second wall (24) are disposed or formed in the groove (16). The first pawl (60) is disposed between the first wall (22) and the ratchet (40), and the second pawl (80) is disposed between the second wall (24) and the ratchet (40). The first wall (22) is configured so that when the first pawl (60) is moved to a first position thereof, for example, due to an elastic force between the first pawl (60) and the inner peripheral wall (20), the first pawl (60) is caught or engaged between the first wall (22) and the ratchet (40), and therefore engaged with the ratchet (40) for transmitting a torque. The second wall (24) is configured so that when the second pawl (80) is moved to a first position thereof, for example, due to an elastic force between the second pawl (80) and the inner peripheral wall (20), the second pawl (80) is caught or engaged between the second wall (24) and the ratchet (40), and therefore engaged with the ratchet (40) for transmitting a torque. Therefore, when the first pawl or second pawl is at its respective first position, said first pawl or second pawl provides a force/torque to the ratchet (40) for driving or rotating a driven element coupled to the ratchet (40); when the first pawl or second pawl is at its respective second position, said first pawl or second pawl does not provide such force/torque to the ratchet (40).

A platform is disposed or formed at a rear end of the groove (16). The platform has a height raised from the bottom wall (18). The control member (100) may be fixed on the platform. One end of the platform is defined by the first wall (22) and the second wall (24). The platform is provided with a hole (H1), through which the control member (100) is pivotally fixed to the platform.

According to a preferred embodiment, the first wall (22) extends from a first end, close to the inner peripheral wall (20), to a second end, close to the second wall (24). The first wall (22) is inclined so that a distance between the second end and the ratchet (40) is shorter than a distance between the first end and the ratchet (40). The second wall (24) extends from a first end, close to the inner peripheral wall (20), to a second end, close to the first wall (22). The second wall (24) is inclined so that a distance between the second end and the ratchet (40) is shorter than a distance between the first end and the ratchet (40).

According to another preferred embodiment, the groove (16) comprises two accommodation chambers for accommodating the first pawl (60) and the second pawl (80), respectively. One accommodation chamber comprises the first wall (22), and the other accommodation chamber comprises the second wall (24). The first wall (22) and the second wall (24) each slope towards the inside to form an upward sloping surface (for example, a straight or curved upward sloping surface), and are inclined towards the front end of the groove (16).

The first pawl (60) is arranged between the first wall (22) of the body (10) and the ratchet (40), and may move between the first position and a second position relative to the ratchet. At the first position, the first pawl (60) is coupled with the ratchet (40) and is supported by the first wall (22) so that the body (10) provides the transmitted torque in a first rotation direction through the first pawl (60). At the second position, the first pawl (60) is separated from the ratchet (40) and does not transmit the torque.

The first pawl (60) comprises a side surface (or first side surface) arranged between the ratchet (40) and the first wall (22) and biased or pressed by a spring (S) so that the first pawl (60) and the second pawl (80) are normally coupled with the ratchet (40). According to an embodiment, one end of the spring (S) is connected to a fastening member (68, 88) firmly urged against the inner peripheral wall. Normally (i.e., in the condition when not controlled by the control member (100)), the first pawl (60), under the force applied by the spring (S), moves along a direction substantially parallel to the first wall (22) towards a tooth portion (42) of the ratchet (40).

The second pawl (80) is arranged between the second wall (24) of the body (10) and the ratchet (40), and may move between the first position and a second position relative to the ratchet. At the first position, the second pawl (80) is coupled with the ratchet (40) and is supported by the second wall (24) so that the body (10) provides the transmitted torque in a second rotation direction through the second pawl (80). At the second position, the second pawl (80) is separated from the ratchet (40) and does not transmit the torque.

The second pawl (80) comprises a side surface (or first side surface) arranged between the ratchet (40) and the second wall (24) and biased or pressed by a spring (S) so that the first pawl (60) and the second pawl (80) are normally coupled with the ratchet (40). According to an embodiment, one end of the spring (S) is connected to a fastening member (68, 88) firmly urged against the inner peripheral wall. The forces applied by the springs (S) are substantially parallel to the first wall (22) and the second wall (24), respectively. Normally (i.e., in the condition when not controlled by the control member (100)), the second pawl (80), under the force applied by the spring (S), moves along a direction substantially parallel to the second wall (24) towards the tooth portion (42) of the ratchet (40). Therefore, as the first pawl (60) and the second pawl (80), under the biased pressing by the spring (S), move further inwards, the teeth are engaged more tightly.

The first pawl (60) and the second pawl (80) are separated from each other by a spacing so that the two do not interfere with each other when moving.

End teeth (66, 86) of teeth (62, 82) of the first pawl (60) and the second pawl (80) each protrude from a side surface (64, 84) (or a second side surface (64, 84)) thereof. Therefore, end teeth (66, 86) can enlarge the contact surface between teeth (62, 82) and tooth portion (42) of ratchet (40) so as to help the first pawl (60) and the second pawl (80), when providing toque, apply force towards the first wall (22) and the second wall (24). Due to end teeth (66,86), a blunt notch is formed between end teeth (66, 86) and the second side surface (64, 84).

As shown in FIGS. 4A, 4B, 5 and 6A, the control member (100) comprises a preferably tapered controlling part (102) which can urge against the second side surface (64, 84). The control member (100) may be coupled with an externally connected switch (120) and fixed by a bolt (101) running through the center of the control member (100). The control member (100) may be operated (for example, by moving, rotating or pulling the switch (120) disposed outside the groove (16)) to stay in at least one of a first position, a second position, and/or a neutral position. As shown in FIG. 6A to FIG. 6D, a rear surface of the control member (100) has a first set of holes (104), a second set of holes (106), and a third set of holes (108), which may be respectively engaged with a pair of steel balls subject to biased pressing by the springs (S).

Figure 6A:
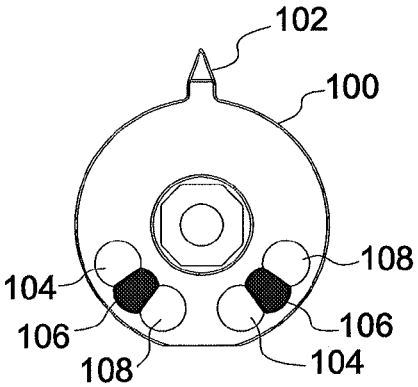
FIG. 6A is a schematic view showing that a control member stays in the middle which is the neutral position or the third position.
Figure 6B:
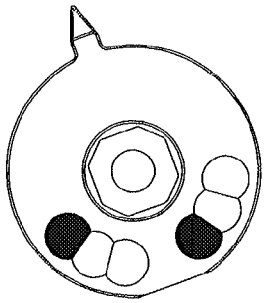
FIG. 6B is a schematic view showing that a control member turns right to be in a first position.
Figure 6C:
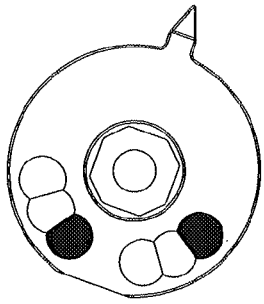
FIG. 6C is a schematic view showing that a control member turns left to be in a second position.
Figure 6D:
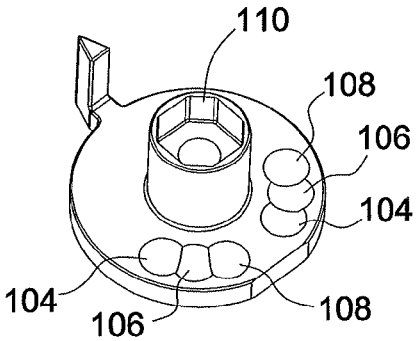
FIG. 6D is a structural view of the back of a control member.
Figure 7:
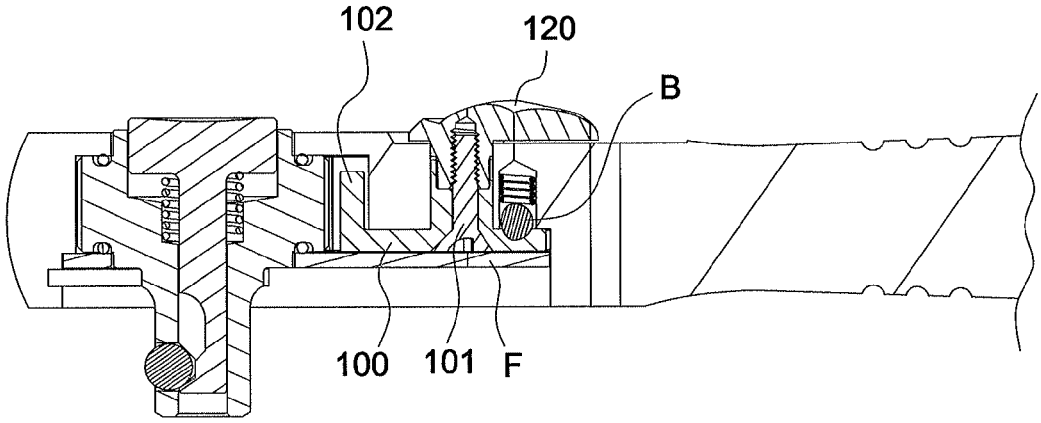
FIG. 7 is a partial sectional view of the present invention.

When the control member (100) is in the first position, as shown in FIG. 6B (the control member (100) turns right), the first set of holes (104) is engaged with the steel balls (B), and the first pawl (60) is coupled with the control member (100), pushes the side surface (64) of the first pawl (60), and is driven by the control member (100) to depart from the first position of the first pawl (60) so that only the second pawl (80) is allowed to be coupled with the ratchet (40) and push the side surface (84) of the second pawl (80), so as to make the body (10) provide the transmitted torque in the second rotation direction. When the control member (100) is in the second position, as shown in FIG. 6C (the control member (100) turns left), the third set of holes (108) is engaged with the steel balls (B), and the second pawl (80) is coupled with the control member (100) and is driven by the control member (100) to depart from the first position of the second pawl (80) so that only the first pawl (60) is allowed to be coupled with the ratchet (40), so as to make the body (10) provide the transmitted torque in the first rotation direction. When the control member (100) is in the neutral position, as shown in FIG. 6A (the control member (100) is in the middle), the second set of holes (106) is engaged with the steel balls (B), the control member (100) is not coupled with the first pawl (60) or the second pawl (80), and the body (10) is allowed to provide the transmitted torque in the first rotation direction and the second rotation direction at the same time, thereby presenting a middle lock state. According to a preferred embodiment of the present invention, in the control member (100), the angle between the first set of holes (104) and the second set of holes (106) or between the second set of holes (106) and the third set of holes (108) is preferably 20 degrees.

During assembly, a fixing member (44) is used to enable the ratchet (40) to be pivotally fixed on the operating part. After all components are mounted in the groove (16), a cover plate (F), a C-shaped ring (C) and a ring (R) close an open end of the groove (16), and then the switch (120) is fixed onto the control member (100). Essentially, the switch (120) and the control member (100) are operatively connected so that it is not limited in the present invention that the control member (100) and the switch (120) are designed to be an integral component or different components.

LIST OF REFERENCE NUMERALS

10 Body
12 Handle
14 Operating part
16 Groove
18 Bottom wall
20 Inner peripheral wall
40 Ratchet
42, 62, 82 Teeth
44 Fixing member
60 First pawl
64, 84 Side surface
66, 86 End teeth
68, 88 Fastening member
80 Second pawl
100 Control member
101 Bolt
102 Controlling part
104 First set of holes
106 Second set of holes
108 Third set of holes
120 Switch
B Steel balls
C C-shaped ring
F Cover plate
H1, H2 Hole
R Ring
S Spring

I claim:

1. A ratchet wrench, comprising:

a body (10);

a ratchet (40), arranged in the body (10) and having a plurality of teeth (42) defining a circumference of the ratchet (40);

a first pawl (60), arranged between the body (10) and the ratchet (40) and capable of moving between positions relative to the ratchet as follows:

a first position, wherein at the first position, the first pawl (60) is coupled with the ratchet (40) so that the body (10) provides a transmitted torque in a first rotation direction through the first pawl (60);

a second position, wherein at the second position, the first pawl (60) does not transmit the torque;

a second pawl (80), arranged between the body (10) and the ratchet (40) and capable of moving between positions relative to the ratchet as follows:

a first position, wherein at the first position, the second pawl (80) is coupled with the ratchet (40) so that the body (10) provides a transmitted torque in a second rotation direction through the second pawl (80);

a second position, wherein at the second position, the second pawl (80) does not transmit the torque;

a control member (100), capable of being operated to stay in one of at least the following positions: a first position and a second position, wherein when the control member (100) is in the first position, the first pawl (60) is coupled with the control member (100), and is therefore away from the first position of the first pawl (60) so that the second pawl (80) is allowed to be coupled with the ratchet (40), so as to enable the body (10) to provide the transmitted torque in the second rotation direction; and when the control member (100) is in the second position, the second pawl (80) is coupled with the control member (100), and is therefore away from the first position of the second pawl (80) so that the first pawl (60) is allowed to be coupled with the ratchet (40), so as to enable the body (10) to provide the transmitted torque in the first rotation direction;

wherein at least one of the first pawl (60) and the second pawl (80) comprises teeth (62, 82) including a tooth (66, 86) protruding from a side surface (64) of said at least one of the first pawl (60) and the second pawl (80) to enlarge the contact surface between teeth (62, 82) and tooth portion (42) of ratchet (40); and wherein the body (10) has an operating part (14); the operating part (14) comprises a groove (16) formed of a bottom wall (18) and an inner peripheral wall (20) surrounding the bottom wall (18) and is used for accommodating the ratchet (40), the first pawl (60), and the second pawl (80); the groove (16) comprises two accommodation chambers which are used to accommodate the first pawl (60) and the second pawl (80); each accommodation chamber comprises a first wall (22) and a second wall (24), and the first wall (22) and the second wall (24) each slope upwardly towards the inside to intersect and for each to form an upward sloping surface.

2. The ratchet wrench according to claim 1, wherein the control member (100) is capable of being operated to stay in a neutral position, and when the control member (100) is in the neutral position, the control member (100) is not coupled with the first pawl (60) or the second pawl (80), and the body (10) is allowed to provide the transmitted torque in the first rotation direction and the second rotation direction at the same time.

3. The ratchet wrench according to claim 2, wherein the first wall (22) and the second wall (24) are disposed in the groove (16), the first pawl (60) is disposed between the first wall (22) and the ratchet (40), the second pawl (80) is disposed between the second wall (24) and the ratchet (40), a conformation of the first wall (22) enables the first pawl (60) to be caught between the first wall (22) and the ratchet (40) and to be engaged with the ratchet (40) when the first pawl (60) is at the first position thereof, so as to provide the transmitted torque; a conformation of the second wall (24) enables the second pawl (80) to be caught between the second wall (24) and the ratchet (40) and to be engaged with the ratchet (40) when the second pawl (80) is at the first position thereof so as to provide the transmitted torque.

4. The ratchet wrench according to claim 2, wherein the first pawl (60) and the second pawl (80) each have a side surface subject to biased pressing by a spring so that the first pawl (60) and the second pawl (80) are normally coupled with the ratchet (40); and the control member (100) is pivotally operated so as to push the first pawl (60) or the second pawl (80) to leave from a state in which the first pawl (60) or the second pawl (80) is coupled with the ratchet (40).

5. The ratchet wrench according to claim 1, wherein the first pawl (60) and the second pawl (80) are separated from each other by a spacing so that the two do not interfere with each other when moving.

6. The ratchet wrench according to claim 5, wherein the first wall (22) and the second wall (24) are disposed in the groove (16), the first pawl (60) is disposed between the first wall (22) and the ratchet (40), the second pawl (80) is disposed between the second wall (24) and the ratchet (40), a conformation of the first wall (22) enables the first pawl (60) to be caught between the first wall (22) and the ratchet (40) and to be engaged with the ratchet (40) when the first pawl (60) is at the first position thereof, so as to provide the transmitted torque; a conformation of the second wall (24) enables the second pawl (80) to be caught between the second wall (24) and the ratchet (40) and to be engaged with the ratchet (40) when the second pawl (80) is at the first position thereof so as to provide the transmitted torque.

7. The ratchet wrench according to claim 1, wherein the first wall (22) and the second wall (24) are disposed in the groove (16), the first pawl (60) is disposed between the first wall (22) and the ratchet (40), the second pawl (80) is disposed between the second wall (24) and the ratchet (40), a conformation of the first wall (22) enables the first pawl (60) to be caught between the first wall (22) and the ratchet (40) and to be engaged with the ratchet (40) when the first pawl (60) is at the first position thereof, so as to provide the transmitted torque; a conformation of the second wall (24) enables the second pawl (80) to be caught between the second wall (24) and the ratchet (40) and to be engaged with the ratchet (40) when the second pawl (80) is at the first position thereof so as to provide the transmitted torque.

8. The ratchet wrench according to claim 1, wherein the first pawl (60) and the second pawl (80) each have a side surface subject to biased pressing by a spring so that the first pawl (60) and the second pawl (80) are normally coupled with the ratchet (40); and the control member (100) is pivotally operated so as to push the first pawl (60) or the second pawl (80) to leave from a state in which the first pawl (60) or the second pawl (80) is coupled with the ratchet (40).

9. The ratchet wrench according to claim 1, wherein the groove (16) comprises a platform, disposed at a rear end of the groove (16), protruding from the bottom wall (18) and used for mounting and fixing the control member (100); and the first wall (22) and the second wall (24) are formed at one end of the platform, wherein the first wall (22) and the second wall (24) are inclined towards a front end of the groove (16).

10. A ratchet wrench comprising:

a body (10);

a ratchet (40), arranged in the body (10) and having a plurality of teeth (42) defining a circumference of the ratchet (40);

a first pawl (60), engaged between the body (10) and the ratchet (40) and capable of moving between positions relative to the ratchet as follows:

a first position, wherein at the first position, the first pawl (60) is coupled with the ratchet (40) so that the body (10) provides a transmitted torque in a first rotation direction through the first pawl (60):

a second position, wherein at the second position, the first pawl (60) does not transmit the torque;

a second pawl (80), arranged between the body (10) and the ratchet (40) and capable of moving between positions relative to the ratchet as follows:

a first position, wherein at the first position, the second pawl (80) is coupled with the ratchet (40) so that the body (10) provides a transmitted torque in a second rotation direction through the second pawl (80);

a second position, wherein at the second position, the second pawl (80) does not transmit the torque;

a control member (100), capable of being operated to stay in one of at least the following positions: a first position and a second position, wherein when the control member (100) is in the first position, the first pawl (60) is coupled with the control member (100), and is therefore away from the first position of the first pawl (60) so that the second pawl (80) is allowed to be coupled with the ratchet (40), so as to enable the body (10) to provide the transmitted torque in the second rotation direction; and when the control member (100) is in the second position, the second pawl (80) is coupled with the control member (100), and is therefore away from the first position of the second pawl (80) so that the first pawl (60) is allowed to be coupled with the ratchet (40), so as to enable the body (10) to provide the transmitted torque in the first rotation direction;

wherein at least one of the first pawl (60) and the second pawl (80) comprises teeth (62, 82) including a tooth (66, 86) protruding from a side surface (64) of said at least one of the first pawl (60) and the second pawl (80) to enlarge the contact Surface between teeth (62, 82) and tooth portion (42) of ratchet (40);

the body (10) has an operating part (14); the operating part (14) comprises a groove (16) formed of a bottom wall (18) and an inner peripheral wall (20) surrounding the bottom wall (18) used to accommodate the ratchet (40), the first pawl (60), and the second pawl (80); and a first wall (22) and a second wall (24) are disposed in the groove (16), the first pawl (60) is disposed between the first wall (22) and the ratchet (40), the second pawl (80) is disposed between the second wall (24) and the ratchet (40), a conformation of the first wall (22) enables the first pawl (60) to be caught between the first wall (22) and the ratchet (40) and to be engaged with the ratchet (40) when the first pawl (60) is at the first position thereof, so as to provide the transmitted torque; a conformation of the second wall (24) enables the second pawl (80) to be caught between the second wall (24) and the ratchet (40) and to be engaged with the ratchet (40) when the second pawl (80) is at the first position thereof so as to provide the transmitted torque;

the first wall (22) extends from a first end close to the inner peripheral wall (20) to a second end close to the second wall (24), and the first wall (22) is inclined so that a distance between the second end and the ratchet (40) is shorter than a distance between the first end and the ratchet (40); and the second wall (24) extends from a first end close to the inner peripheral wall (20) to a second end close to the first wall (22), and the second wall (24) is inclined so that a distance between the second end and the ratchet (40) is shorter than a distance between the first end and the ratchet (40).

11. A ratchet wrench comprising:

a body (10);

a ratchet (40), arranged in the body (10) and having a plurality of teeth (42) defining a circumference of the ratchet (40);

a first pawl (60), engaged between the body (10) and the ratchet (40) and capable of moving between positions relative to the ratchet as follows:

a first position, wherein at the first position, the first pawl (60) is coupled with the ratchet (40) so that the body (10) provides a transmitted torque in a first rotation direction through the first pawl (60):

a second position, wherein at the second position, the first pawl (60) does not transmit the torque;

a second pawl (80), arranged between the body (10) and the ratchet (40) and capable of moving between positions relative to the ratchet as follows:

a first position, wherein at the first position, the second pawl (80) is coupled with the ratchet (40) so that the body (10) provides a transmitted torque in a second rotation direction through the second pawl (80);

a second position, wherein at the second position, the second pawl (80) does not transmit the torque;

a control member (100), capable of being operated to stay in one of at least the following positions: a first position and a second position, wherein when the control member (100) is in the first position, the first pawl (60) is coupled with the control member (100), and is therefore away from the first position of the first pawl (60) so that the second pawl (80) is allowed to be coupled with the ratchet (40), so as to enable the body (10) to provide the transmitted torque in the second rotation direction; and when the control member (100) is in the second position, the second pawl (80) is coupled with the control member (100), and is therefore away from the first position of the second pawl (80) so that the first pawl (60) is allowed to be coupled with the ratchet (40), so as to enable the body (10) to provide the transmitted torque in the first rotation direction;

wherein at least one of the first pawl (60) and the second pawl (80) comprises teeth (62, 82) including a tooth (66, 86) protruding from a side surface (64) of said at least one of the first pawl (60) and the second pawl (80) to enlarge the contact Surface between teeth (62, 82) and tooth portion (42) of ratchet (40);

the control member (100) is capable of being operated to stay in a neutral position, and when the control member (100) is in the neutral position, the control member (100) is not coupled with the first pawl (60) or the second pawl (80), and the body (10) is allowed to provide the transmitted torque in the first rotation direction and the second rotation direction at the same time;

the body (10) has an operating part (14); the operating part (14) comprises a groove (16) formed of a bottom wall (18) and an inner peripheral wall (20) surrounding the bottom wall (18) used to accommodate the ratchet (40), the first pawl (60), and the second pawl (80); and a first wall (22) and a second wall (24) are disposed in the groove (16), the first pawl (60) is disposed between the first wall (22) and the ratchet (40), the second pawl (80) is disposed between the second wall (24) and the ratchet (40), a conformation of the first wall (22) enables the first pawl (60) to be caught between the first wall (22) and the ratchet (40) and to be engaged with the ratchet (40) when the first pawl (60) is at the first position thereof, so as to provide the transmitted torque; a conformation of the second wall (24) enables the second pawl (80) to be caught between the second wall (24) and the ratchet (40) and to be engaged with the ratchet (40) when the second pawl (80) is at the first position thereof so as to provide the transmitted torque; wherein the first wall (22) extends from a first end close to the inner peripheral wall (20) to a second end close to the second wall (24), and the first wall (22) is inclined so that a distance between the second end and the ratchet (40) is shorter than a distance between the first end and the ratchet (40); and the second wall (24) extends from a first end close to the inner peripheral wall (20) to a second end close to the first wall (22), and the second wall (24) is inclined so that a distance between the second end and the ratchet (40) is shorter than a distance between the first end and the ratchet (40).

12. A ratchet wrench comprising:

a body (10);

a ratchet (40), arranged in the body (10) and having a plurality of teeth (42) defining a circumference of the ratchet (40);

a first pawl (60), engaged between the body (10) and the ratchet (40) and capable of moving between positions relative to the ratchet as follows:

a first position, wherein at the first position, the first pawl (60) is coupled with the ratchet (40) so that the body (10) provides a transmitted torque in a first rotation direction through the first pawl (60):

a second position, wherein at the second position, the first pawl (60) does not transmit the torque;

a second pawl (80), arranged between the body (10) and the ratchet (40) and capable of moving between positions relative to the ratchet as follows:

a first position, wherein at the first position, the second pawl (80) is coupled with the ratchet (40) so that the body (10) provides a transmitted torque in a second rotation direction through the second pawl (80);

a second position, wherein at the second position, the second pawl (80) does not transmit the torque;

a control member (100), capable of being operated to stay in one of at least the following positions: a first position and a second position, wherein when the control member (100) is in the first position, the first pawl (60) is coupled with the control member (100), and is therefore away from the first position of the first pawl (60) so that the second pawl (80) is allowed to be coupled with the ratchet (40), so as to enable the body (10) to provide the transmitted torque in the second rotation direction; and when the control member (100) is in the second position, the second pawl (80) is coupled with the control member (100), and is therefore away from the first position of the second pawl (80) so that the first pawl (60) is allowed to be coupled with the ratchet (40), so as to enable the body (10) to provide the transmitted torque in the first rotation direction;

wherein at least one of the first pawl (60) and the second pawl (80) comprises teeth (62, 82) including a tooth (66, 86) protruding from a side surface (64) of said at least one of the first pawl (60) and the second pawl (80) to enlarge the contact Surface between teeth (62, 82) and tooth portion (42) of ratchet (40);

the first pawl (60) and the second pawl (80) are separated from each other by a spacing so that the two do not interfere with each other when moving;

the body (10) has an operating part (14); the operating part (14) comprises a groove (16) formed of a bottom wall (18) and an inner peripheral wall (20) surrounding the bottom wall (18) used to accommodate the ratchet (40), the first pawl (60), and the second pawl (80); and a first wall (22) and a second wall (24) are disposed in the groove (16), the first pawl (60) is disposed between the first wall (22) and the ratchet (40), the second pawl (80) is disposed between the second wall (24) and the ratchet (40), a conformation of the first wall (22) enables the first pawl (60) to be caught between the first wall (22) and the ratchet (40) and to be engaged with the ratchet (40) when the first pawl (60) is at the first position thereof, so as to provide the transmitted torque; a conformation of the second wall (24) enables the second pawl (80) to be caught between the second wall (24) and the ratchet (40) and to be engaged with the ratchet (40) when the second pawl (80) is at the first position thereof so as to provide the transmitted torque; wherein the first wall (22) extends from a first end close to the inner peripheral wall (20) to a second end close to the second wall (24), and the first wall (22) is inclined so that a distance between the second end and the ratchet (40) is shorter than a distance between the first end and the ratchet (40); and the second wall (24) extends from a first end close to the inner peripheral wall (20) to a second end close to the first wall (22), and the second wall (24) is inclined so that a distance between the second end and the ratchet (40) is shorter than a distance between the first end and the ratchet (40).

* * * * *